US009932864B2

(12) United States Patent
Junker et al.

(10) Patent No.: US 9,932,864 B2
(45) Date of Patent: Apr. 3, 2018

(54) VALVE TRAIN OF A RECIPROCATING PISTON INTERNAL COMBUSTION ENGINE

(71) Applicant: Schaeffler Technologies AG & Co. KG, Herzogenaurach (DE)

(72) Inventors: Marco Junker, Obernzenn (DE); Norbert Geyer, Hochstadt (DE); Steffen Gumbrecht, Falkendorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 52 days.

(21) Appl. No.: 15/150,733

(22) Filed: May 10, 2016

(65) Prior Publication Data

US 2016/0369660 A1 Dec. 22, 2016

(30) Foreign Application Priority Data

Jun. 17, 2015 (DE) ..... 10 2015 211 124

(51) Int. Cl.

| | |
|---|---|
| ***F01M 11/02*** | (2006.01) |
| ***F01L 1/18*** | (2006.01) |
| ***F01L 1/24*** | (2006.01) |
| *F01L 1/26* | (2006.01) |
| *F01M 9/10* | (2006.01) |
| *F01L 1/053* | (2006.01) |

(52) U.S. Cl.

CPC ..... *F01L 1/181* (2013.01); *F01L 1/24* (2013.01); *F01L 1/2411* (2013.01); *F01L 1/26* (2013.01); *F01L 1/053* (2013.01); *F01L 1/267* (2013.01); *F01M 9/105* (2013.01)

(58) Field of Classification Search

CPC ..... F01L 1/181; F01L 1/2411; F01L 1/267; F01M 9/103; F01M 9/105

USPC ..... 123/90.36, 90.4, 90.46

See application file for complete search history.

(56) References Cited

U.S. PATENT DOCUMENTS

| | | | | |
|---|---|---|---|---|
| 2,380,051 | A * | 7/1945 | Kettering | F01L 1/181 123/90.4 |
| 4,924,821 | A * | 5/1990 | Teerman | F01L 1/2411 123/90.22 |
| 8,813,719 | B2 | 8/2014 | Sailer et al. | |
| 2005/0211206 | A1* | 9/2005 | Ruggiero | F01L 1/08 123/90.16 |
| 2010/0170471 | A1* | 7/2010 | Yang | F01L 1/08 123/321 |
| 2016/0273416 | A1* | 9/2016 | Coffey | F01L 1/2411 |

FOREIGN PATENT DOCUMENTS

| | | |
|---|---|---|
| DE | 102010011454 | 9/2011 |

* cited by examiner

*Primary Examiner* — Jorge Leon, Jr.
(74) *Attorney, Agent, or Firm* — Volpe and Koenig, P.C.

(57) ABSTRACT

A valve train for a reciprocating piston internal combustion engine with a transmission element in the form of a rocker arm (1) or pivot arm that can be actuated, on one hand, at least indirectly by a cam of a camshaft and is in active connection, on the other hand, through an intermediate connection of a valve bridge (4), with gas-exchange valves (7, 8). The valve bridge (4) has hydraulic valve lash compensation elements ("HVAs") allocated to each gas-exchange valve (7, 8).

7 Claims, 3 Drawing Sheets

VALVE TRAIN OF A RECIPROCATING PISTON INTERNAL COMBUSTION ENGINE

INCORPORATION BY REFERENCE

The following documents are incorporated herein by reference as if fully set forth: German Patent Application No. 102015211124.5, filed Jun. 17, 2015.

BACKGROUND

The invention relates to a valve train of a reciprocating piston internal combustion engine with a transmission element in the form of a rocker arm or pivot arm that can be actuated, on one hand, at least indirectly by a cam of a camshaft and is in active connection, on the other hand, under intermediate connection of a valve bridge, with gas-exchange valves, wherein the valve bridge has at least one hydraulic valve lash compensation element, also called "HVA" below.

Such a valve train according to the class is known from DE 10 2010 011 454 A1. The document describes two constructions, wherein one construction has a bridge that is provided on one end with a hydraulic valve lash compensation element. Because this HVA can perform lash compensation for only one gas-exchange valve, the transmission element has, on its end, an adjusting screw with spherical cap so that the gas-exchange valve provided with an HVA must be adjusted and readjusted using the adjusting screw. In the second construction, the HVA is arranged in the middle of the valve bridge, wherein the connection to the transmission element is realized, in turn, by an adjusting screw and a spherical cap. Here it is not clear how differences in the length and extensions of the gas-exchange valves are to be set, because the HVA is active for both gas-exchange valves and must have an appropriately large volume construction.

SUMMARY

The object of the invention is to provide a valve train, in which the previously described disadvantages are eliminated. The components of the valve train should have a simple, space-saving, and economical construction.

This objective is achieved in that, in the valve bridge, allocated to each gas-exchange valve, there is a hydraulic valve lash compensation element. In this way it is possible that the lash of each gas-exchange valve is readjusted individually and automatically and also the total adjustment is realized by the two valve lash compensation elements, so that an adjusting screw is not required. Through the allocation of one HVA to each gas-exchange valve, each hydraulic valve lash compensation element can be kept spatially small, in particular, it can have a narrow construction transverse to the valve bridge. This is especially important due to the limited installation space in four valve cylinder heads with central injectors. It is further proposed that, at the end of the transmission element, a spherical head tappet and a spherical cup are formed/installed, wherein the spherical cup contacts the valve bridge. A good pressurized medium supply is ensured in that, in the transmission element, starting from a pivot bearing supplied with pressurized medium, there is a pressurized medium line that connects to a pressurized medium hole in the spherical head tappet and to an opening in the spherical cup and that, in the valve bridge, starting from the spherical cup, there are pressurized medium channels that lead to the hydraulic valve lash compensation elements. To ensure that there is a passage for pressurized medium at all times between the spherical cup and the pressurized medium channels, it is provided that the pressurized medium channels are attached, in the valve bridge, facing the spherical cup, to an extension in the form of a cone or spherical section. In this way, shifts between the spherical cup and the bridge due to the tolerances are not critical.

BRIEF DESCRIPTION OF THE DRAWINGS

The invention is described in the detailed description below which should be read in conjunction with the drawings, in which.

DETAILED DESCRIPTION OF THE PREFERRED EMBODIMENTS

Figure 1:
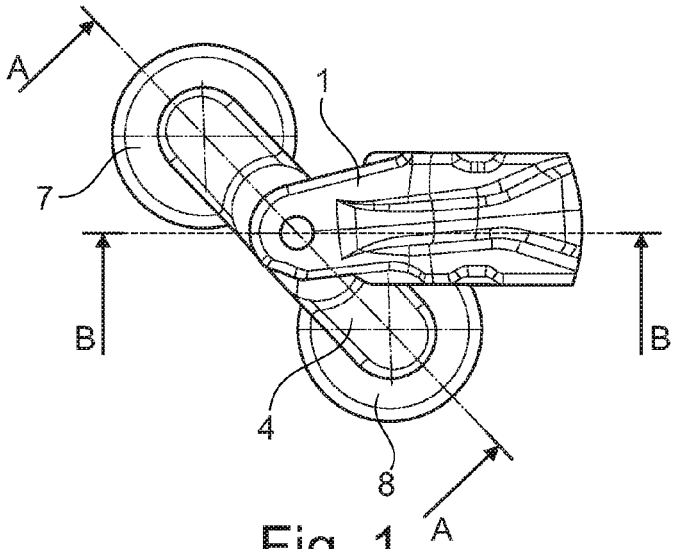
FIG. 1 shows a plan view of the end of a transmission element and a valve bridge.
Figure 2:
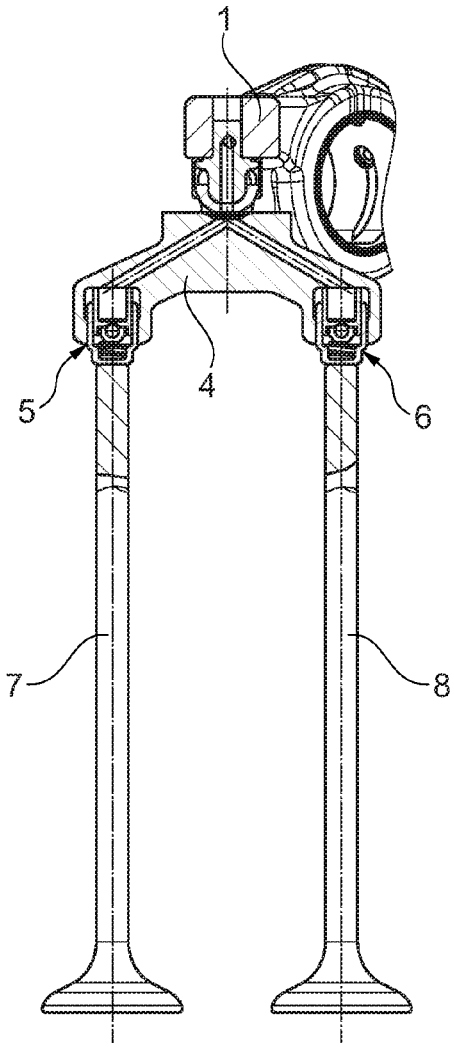
FIG. 2 shows a section through the end of the transmission element and through the valve bridge according to the line A-A in FIG. 1.
Figure 3:
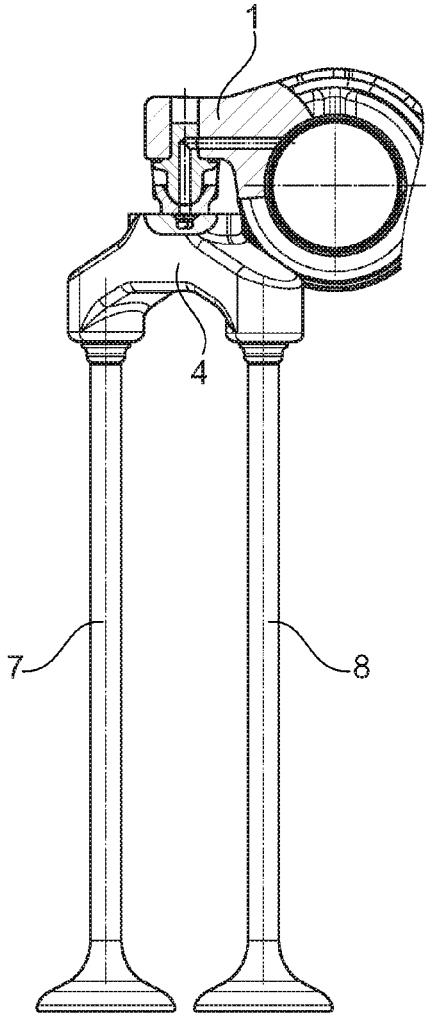
FIG. 3 shows a section through the end of the transmission element with partial section through the valve bridge according to the line B-B in FIG. 1.
Figure 4:
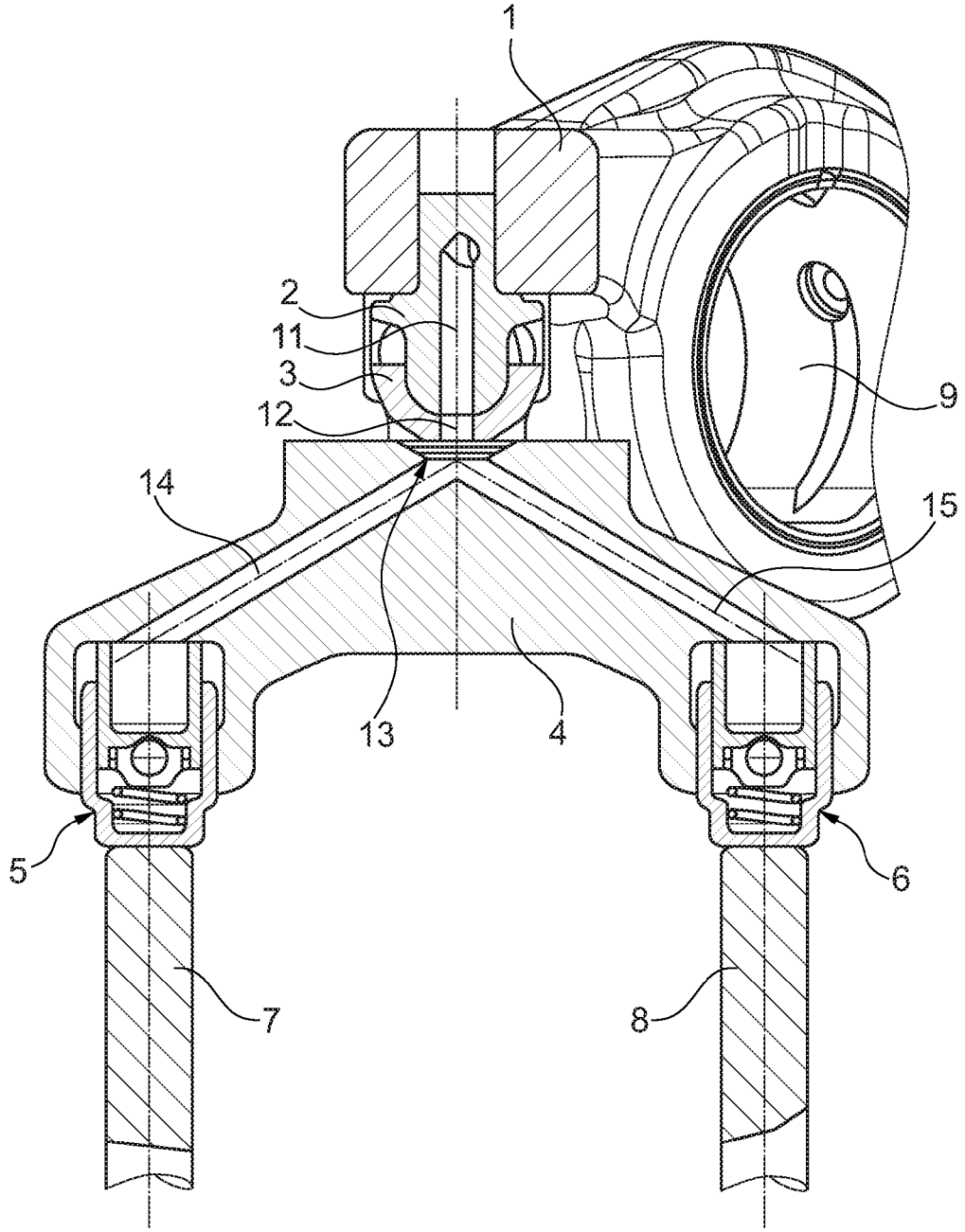
FIG. 4 shows a section from the illustration according to FIG. 2 at an enlarged scale.
Figure 5:
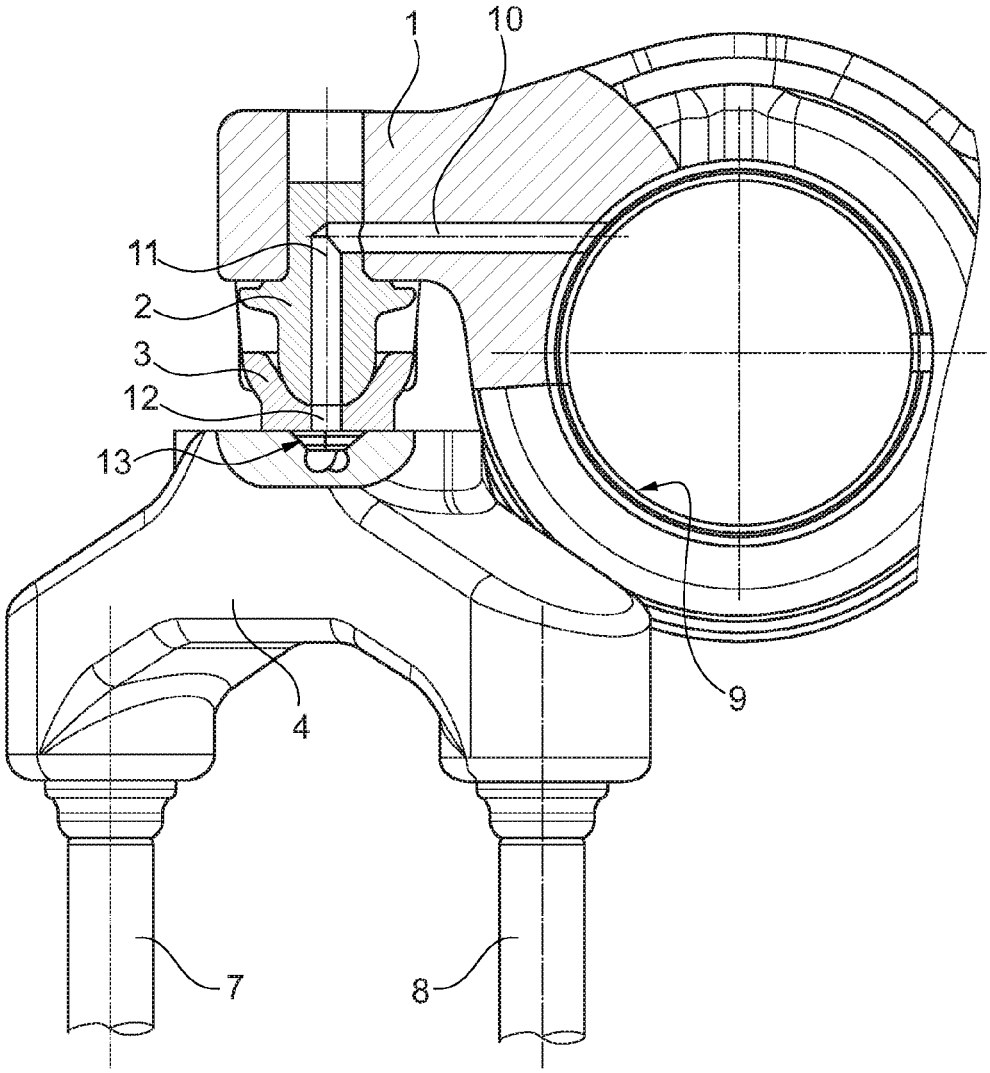
FIG. 5 shows a view corresponding to FIG. 3 also at an enlarged scale.

In FIGS. 1 to 5, as far as shown in detail, 1 designates a rocker arm on whose end, in a hole, a spherical head tappet 2 is inserted that is in active connection with a spherical cup 3. The spherical cup 3 contacts a valve bridge 4 that includes, on each of its ends, a hydraulic valve lash compensation element 5 and 6. Because HVAs have already been generally known for a long time, they will not be discussed in more detail below. These are in active connection with gas-exchange valves 7 and 8. Starting from a pivot bearing 9 of the rocker arm 1, a pressurized medium line 10 is provided that leads to a pressurized medium hole 11 in the spherical head tappet 2 and from there to an opening 12 in the spherical cup 3. The opening 12 is in active connection with an extension 13 in the valve bridge 4, from which pressurized medium channels 14 and 15 lead to the hydraulic valve lash compensation elements 5 and 6. The hydraulic valve lash compensation elements 5 and 6 are thus reliably provided with pressurized medium, so that these adjust the existing lash to a specified measure for the typical movement of the rocker arm 1, the valve bridge 4, and the gas-exchange valves 7 and 8.

LIST OF REFERENCE SYMBOLS

1) Rocker arm
2) Spherical head tappet
3) Spherical cup
4) Valve bridge
5), 6) Hydraulic valve lash compensation element
7), 8) Gas-exchange valves
9) Swivel bearing
10) Pressurized medium line
11) Pressurized medium hole
12) Opening
13) Extension
14), 15) Pressurized medium channels

The invention claimed is:

1. A valve train for a reciprocating piston internal combustion engine, comprising an arm that is actuatable at least indirectly by a cam of a camshaft, a valve bridge and gas exchange valves, the arm is in active connection with the gas-exchange valves through an intermediate connection of the valve bridge, hydraulic valve lash compensation elements provided in the valve bridge that are allocated to each of the gas-exchange valves, and a spherical head tappet and a spherical cup located on an end of the arm, wherein a pressurized medium line sequentially connects a pressurized medium hole in the spherical head tappet, an opening in the spherical cup, an extension formed in the valve bridge, the extension being in the form of a sphere or spherical section, and pressurized medium channels extending through the valve bridge to the hydraulic valve lash compensation elements.

2. The valve train according to claim 1, wherein the arm comprises a rocker arm or pivot arm.

3. The valve train according to claim 1, wherein the spherical cup contacts the valve bridge.

4. The valve train according to claim 1, wherein the arm includes a pivot bearing at the spherical head tappet.

5. The valve train according to claim 1, wherein the extension has a width greater than a width of the opening in the spherical cup to ensure passage of pressurized medium at all times between the spherical cup and the pressurized medium channels of the valve bridge.

6. The valve train according to claim 1, wherein the extension is positioned directly between the pressurized medium channels and the spherical cup.

7. The valve train according to claim 1, wherein the pressurized medium hole in the spherical head tappet extends partially through a height of the spherical head tappet such that a height of the spherical head tappet is greater than a height of the pressurized medium hole.

* * * * *